US008929784B2

(12) United States Patent
Takazawa

(10) Patent No.: US 8,929,784 B2
(45) Date of Patent: Jan. 6, 2015

(54) ROTATING BODY, TRANSFER UNIT, AND IMAGE FORMING APPARATUS

(75) Inventor: Takayuki Takazawa, Tokyo (JP)

(73) Assignee: Oki Data Corporation, Tokyo (JP)

( * ) Notice: Subject to any disclaimer, the term of this patent is extended or adjusted under 35 U.S.C. 154(b) by 75 days.

(21) Appl. No.: 13/572,028

(22) Filed: Aug. 10, 2012

(65) Prior Publication Data

US 2013/0051838 A1 Feb. 28, 2013

(30) Foreign Application Priority Data

Aug. 23, 2011 (JP) ..... 2011-181630

(51) Int. Cl.
*G03G 15/01* (2006.01)
*G03G 15/16* (2006.01)

(52) U.S. Cl.
CPC ..... *G03G 15/0194* (2013.01); *G03G 15/162* (2013.01)
USPC ..... 399/303; 399/101; 399/162

(58) Field of Classification Search
CPC ..... G03G 15/162; G03G 15/0194; G03G 15/1685; G03G 2215/1623
USPC ..... 399/99, 101, 308, 313, 162, 303
See application file for complete search history.

(56) References Cited

U.S. PATENT DOCUMENTS

| | | | | |
|---|---|---|---|---|
| 5,761,594 | A * | 6/1998 | Seto et al. | 399/302 |
| 5,878,314 | A * | 3/1999 | Takaya et al. | 399/302 |
| 6,016,417 | A * | 1/2000 | Katsuno et al. | 399/308 |
| 6,078,775 | A * | 6/2000 | Arai et al. | 399/308 |
| 6,133,927 | A * | 10/2000 | Arai et al. | 347/131 |
| 6,643,487 | B1 * | 11/2003 | Shimmura | 399/302 |
| 7,298,999 | B2 * | 11/2007 | Yoshida | 399/302 |
| 7,856,200 | B2 * | 12/2010 | Wada et al. | 399/303 |
| 8,064,812 | B2 * | 11/2011 | Meade et al. | 399/302 |
| 8,175,496 | B2 * | 5/2012 | Miyamoto | 399/162 |
| 8,190,052 | B2 * | 5/2012 | Tanaka | 399/101 |
| 8,442,420 | B2 * | 5/2013 | Shimazu | 399/302 |
| 8,660,465 | B2 * | 2/2014 | Kim et al. | 399/159 |
| 2009/0074492 | A1 * | 3/2009 | Ito | 399/388 |
| 2010/0300604 | A1 * | 12/2010 | Goss et al. | 156/154 |
| 2012/0099897 | A1 * | 4/2012 | Kim et al. | 399/159 |

FOREIGN PATENT DOCUMENTS

| | | | |
|---|---|---|---|
| JP | H04-303870 | A | 10/1992 |
| JP | 2007-225969 | A | 9/2007 |

* cited by examiner

*Primary Examiner* — David Gray
*Assistant Examiner* — Carla Therrien
(74) *Attorney, Agent, or Firm* — Panitch Schwarze Belisario & Nadel LLP

(57) ABSTRACT

A rotating body for use in an image forming apparatus has an outer surface in which one or more grooves are formed. The one or more grooves are oriented at an angle greater than 0° and less than 90° with respect to a longitudinal direction of the rotating body.

9 Claims, 4 Drawing Sheets

ROTATING BODY, TRANSFER UNIT, AND IMAGE FORMING APPARATUS

FIELD OF THE INVENTION

The present invention relates to a rotating body, a transfer unit, and an image forming apparatus.

DESCRIPTION OF THE RELATED ART

There is a great demand for electrophotographic image forming apparatuses with full-color printout quality approaching silver-halide printout quality. To attain this level of quality, several approaches have been proposed, such as reducing the size of toner particles, making them more spherical in shape, and including a release agent such as wax in the toner. The image forming apparatus disclosed by Itoh in Japanese Patent Application Publication No. 2007-225969, for example, utilizes a toner of this type. The image forming apparatus also has a cleaning blade made of an elastic material such as urethane rubber to clean the endless belt used for transferring the toner image onto the recording medium. In order to improve the cleaning performance, Itoh proposes that the endless belt should have a ten-point average roughness Rz of 0.2 micrometer (μm) or less and a specularity of 100 or more.

These proposals do not, however, address the Problems of durability of the belt, blade, and image forming apparatus.

SUMMARY OF THE INVENTION

In an aspect of the present invention, it is intended to improve the durability of an image forming apparatus including a rotating body.

According to an aspect of the present invention, there is provided a rotating body for use in an image forming apparatus. The rotating body has an outer surface in which one or more grooves are formed. The one or more grooves are oriented at an angle θ to a longitudinal direction of the rotating body. The angle θ is greater than 0° and less than 90° ($0° < \theta < 90°$).

According to another aspect of the present invention, there is provided a transfer unit including: the above described rotating body; a drive member for turning the rotating body; a transfer member for transferring a developer image onto the rotating body or onto a recording medium carried on the rotating body; and a cleaning member making contact with the outer surface of the rotating body.

According to still another aspect of the present invention, there is provided an image forming apparatus including: the above described transfer unit; and an image forming unit for forming the developer image.

DETAILED DESCRIPTION OF THE INVENTION

Figure 1:
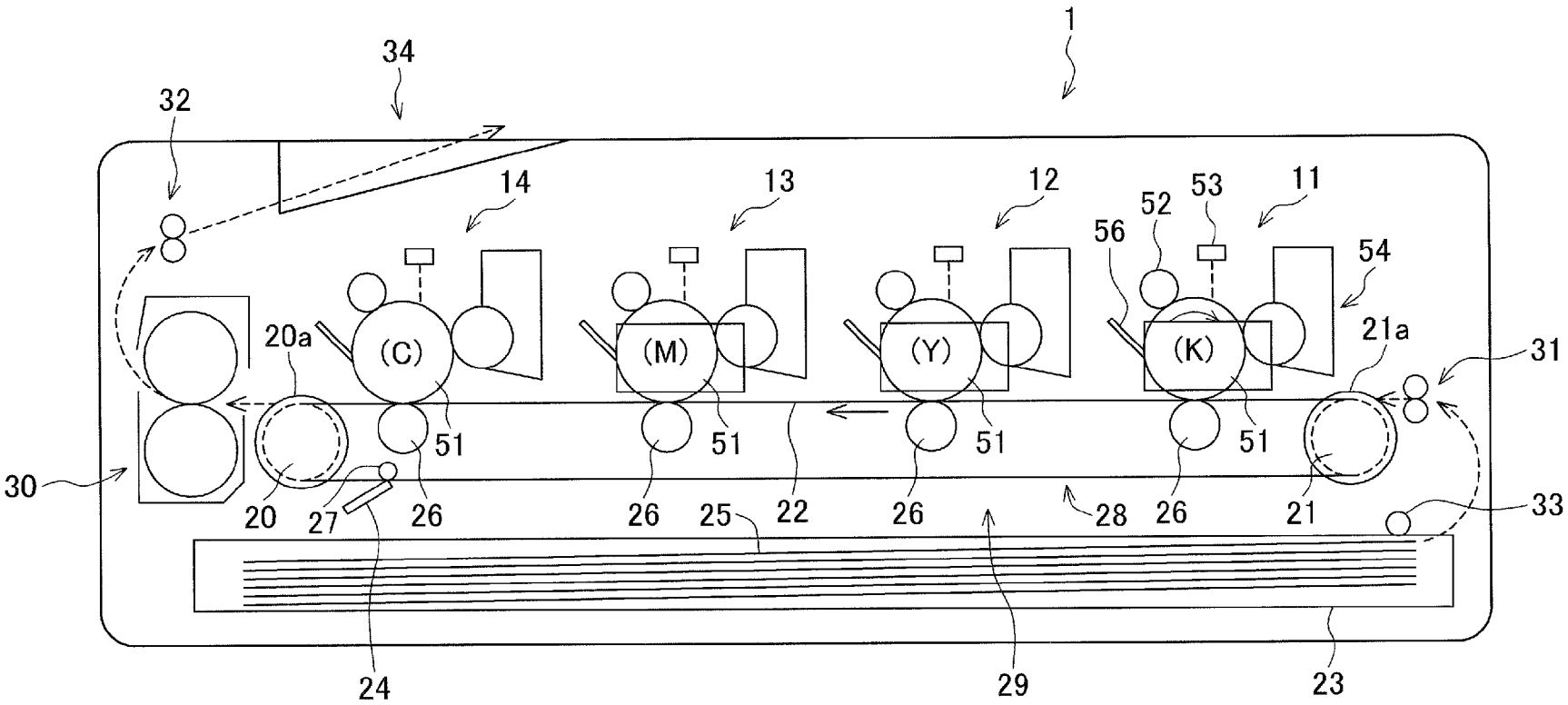
FIG. 1 is a schematic side sectional view illustrating the structure of an image forming apparatus in a first embodiment of the invention.

Embodiments of the invention will now be described with reference to the attached drawings, in which like elements are indicated by like reference characters.

First Embodiment

Referring to FIG. 1, the first embodiment is an image forming apparatus 1 that forms an image using an endless belt as the rotating body. More specifically, the image forming apparatus 1 is a tandem color electrophotographic printer of the direct transfer type.

The image forming apparatus 1 includes image forming units 11 to 14 for forming toner images as developer images in colors of black (K), yellow (Y), magenta (M), and cyan (C). These image forming units 11 to 14 are disposed sequentially in the upstream to downstream direction of the transport path of the paper 25 used as a recording medium.

The black image forming unit 11 includes a photosensitive drum 51 serving as an electrostatic latent image carrier, a charging roller 52 serving as a charging unit, a light-emitting diode (LED) head 53 serving as an exposure unit, a developing unit 54, and a cleaning blade 56 serving as a cleaning unit. The charging roller 52 charges the surface of the photosensitive drum 51. The LED head 53 selectively illuminates the charged surface of the photosensitive drum 51 according to image data to form an electrostatic latent image on the photosensitive drum 51. The developing unit 54 develops the electrostatic latent image by applying toner to create a toner image. The cleaning blade 56 is disposed in abutting contact with the photosensitive drum 51 to remove residual toner from the surface of the photosensitive drum 51. All four image forming units have the same structure, so descriptions of image forming units 12 to 14 will be omitted.

As a mechanism for feeding paper 25 to the image forming units 11 to 14, the image forming apparatus 1 includes a cassette 23 in which the paper 25 is stored, a hopping roller 33 for withdrawing sheets of paper 25 from the cassette 23, and a pair of transport rollers 31 for transporting the withdrawn sheets toward the image forming units 11 to 14.

The image forming apparatus 1 further includes a transfer unit 29 for transferring the toner images formed by the image forming units 11 to 14 onto the paper 25, a fusing unit 30 disposed downstream of the transfer unit 29 to apply heat and pressure to the toner image on the paper 25, and a pair of transport rollers 32 disposed downstream of the fusing unit 30 to deliver the paper 25 onto a tray 34.

Figure 2:
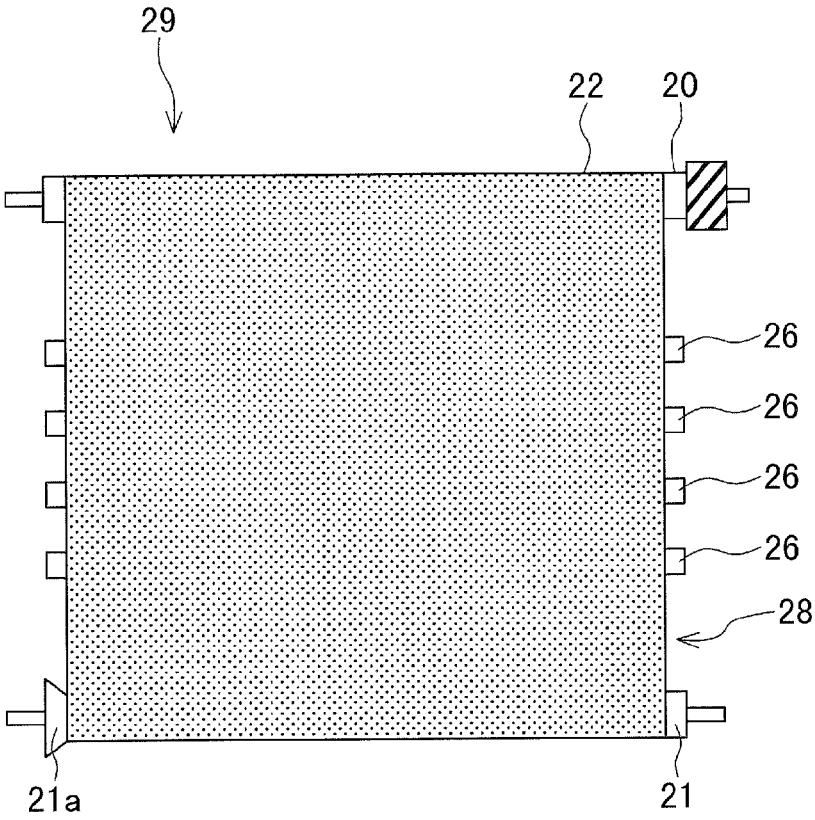
FIG. 2 is a plan view illustrating the structure of the transfer unit in FIG. 1.

Referring to FIGS. 1 and 2, the transfer unit 29 includes four transfer rollers 26 each serving as a transfer member, and a belt unit 28. The belt unit 28 includes a belt 22 formed as an endless loop, a drive roller 20, a driven roller (or tension roller) 21, a cleaning blade 24 serving as a cleaning member, and a support roller 27. The drive roller 20 serves as a drive member for turning the belt 22, and the driven roller 21 serves as a driven member which makes contact with the inner surface of the belt 22. The belt 22 is entrained around the drive roller 20 and the driven roller 22. As the drive roller 20 rotates, the belt 22 moves in the direction of the arrow in FIG. 1. The paper 25 fed from the transport rollers 31 onto the outer surface of the belt 22 is thereby carried past the image forming units 11 to 14 in turn. The transfer rollers 26 are disposed facing the photosensitive drums 51 in respective image forming units 11 to 14. The belt 22 and paper 25 pass between each transfer roller 26 and the facing photosensitive drum 51. The transfer roller 26 transfers the toner image from the photosensitive drum 51 onto the paper 25 as the paper 25 is carried on the belt 22.

The cleaning blade 24 is disposed in contact or sliding contact with the outer surface of the belt 22 to scrape off residual toner on the outer surface of the belt 22. The belt 22 passes between the cleaning blade 24 and the support roller 27.

Rollers 20 and 21 may have respective meander prevention collars 20*a*, 21*a* that engage the edge of the belt 22. Such collars may be provided on one or both sides of the belt 22, and on one or both of the rollers 20, 21. In the exemplary configuration in FIG. 2, there is only one collar 21*a*, disposed on the driven roller 21 on one side of the belt 22. As shown in FIG. 2, the collar 21*a* is a flange with a sloping section that meets the edge of the belt 22. The sloping section guides the edge of the belt 22 and limits horizontal movement of the belt 22, thereby keeping the belt 22 from meandering.

In the exemplary structure shown in FIGS. 1 and 2, two rollers 20, 21 are used to entrain the belt 22 in a tensioned state, but three or more rollers may be used for this purpose.

The operation of the image forming apparatus 1 will now be briefly described with reference to FIG. 1. The dashed arrows in FIG. 1 indicate the direction of paper travel.

In each of the image forming units 11 to 14, as the photosensitive drum 51 rotates in the direction indicated by the arrow, the surface of the photosensitive drum 51 is charged by a voltage applied to the charging roller 52. When the charged surface of the photosensitive drum 51 comes beneath the LED head 53 and is selectively illuminated by the LED head 53, an electrostatic latent image is formed on the photosensitive drum 51. The electrostatic latent image is developed with toner applied by the developing unit 54 so that a toner image is formed on the surface of the photosensitive drum 51.

A sheet of paper 25 is picked up from the cassette 23 by the hopping roller 33 and fed onto the belt 22 by the transport rollers 31. As the paper 25 is conveyed on the belt 22, it passes beneath the image forming units 11 to 14 in turn. The toner image formed on the surface of the photosensitive drum 51 in each of the image forming units 11 to 14 is brought toward the transfer roller 26 and belt 22 by the rotation of the photosensitive drum 51 and then transferred onto the paper 25 by electrostatic force created by a voltage applied to the transfer roller 26. As the paper 25 passes beneath the image forming units 11 to 14, toner images in four separate colors are transferred onto the paper 25 in proper registration, one upon another, to form the intended full-color image on the paper 25.

The paper 25 bearing the toner image on its surface is then conveyed by the rotation of the belt 22 to the fusing unit 30. The pressure and heat applied by the fusing unit 30 fuse the toner image so that it is permanently fixed to the paper 25. The paper 25 is then delivered onto the tray 34 and the image forming operation ends. After the paper 25 leaves the belt 22, the surface of the belt 22 is cleaned by the cleaning blade 24 to remove residual toner and other foreign matter.

The structure of the belt 22 will now be described in detail with reference to FIGS. 3 and 4. The left side of the highly schematic depiction in FIG. 3 shows a perspective view of the belt 22, while the right side shows a front elevational view of the belt 22.

To improve the durability of the image forming apparatus, one or more grooves are formed on the surface of the belt 22. As shown in FIG. 3, the grooves 22*c* are oriented at a slant with respect to both the longitudinal direction 22*a* of the belt 22 and rotational axis 22*b* of the belt 22. The longitudinal direction 22*a* is substantially parallel to the moving direction of the surface of the belt 22. That is, the drive roller 20 turns the belt 22 in a direction substantially parallel to the longitudinal direction 22*a*. The angle θa between the direction in which the grooves 22*c* extend and the longitudinal direction 22*a* is greater than 0° and less than 90° (0°<θa<90°). The angle θb formed between the direction in which the grooves 22*c* extend and the rotational axis 22*b*, which is equal to the angle (90°−θa) obtained by subtracting θa from 90°, is likewise greater than 0° and less than 90° (0°<θb<90°). The symbol θa indicates the smallest of the angles between the direction of the grooves 22*c* and the longitudinal direction 22*a*; θb likewise indicates the smallest of the angles between the direction of the grooves 22*c* and the rotational axis 22*b*.

Figure 3:
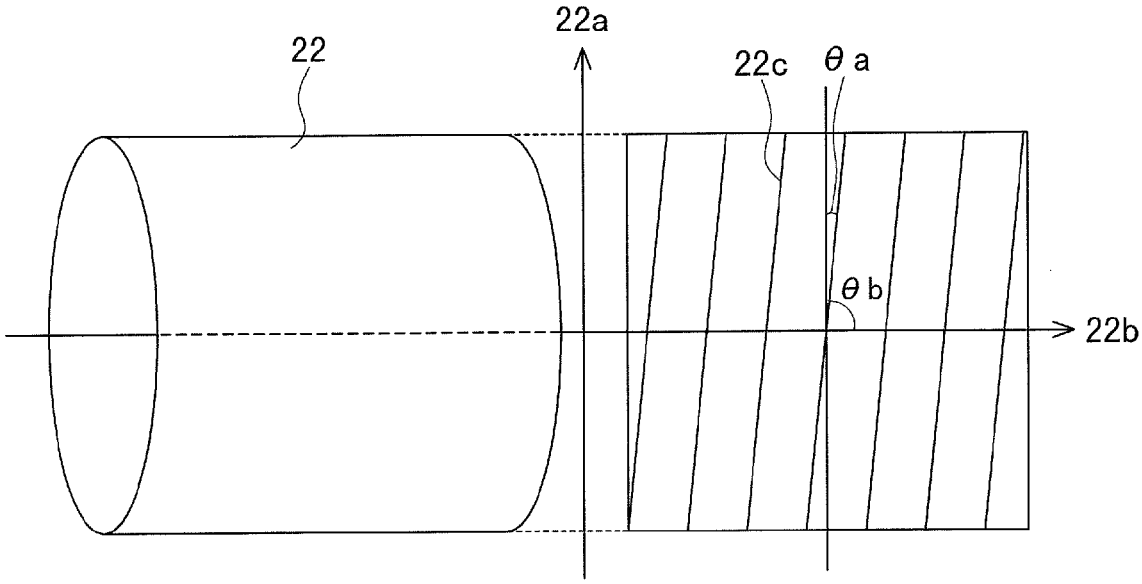
FIG. 3 schematically illustrates an exemplary groove pattern on the belt in FIGS. 1 and 2.

Although the grooves 22*c* are angled to the right of the longitudinal direction 22*a* in the example in FIG. 3, they may be angled toward the left instead. Continuous printing tests, described later, were carried out on both types of belts. The results showed no significant difference between the two cases. That is, belts having grooves angled to the right by θa and belts having grooves angled to the left by the same θa gave equivalent durability performance.

Figure 4:
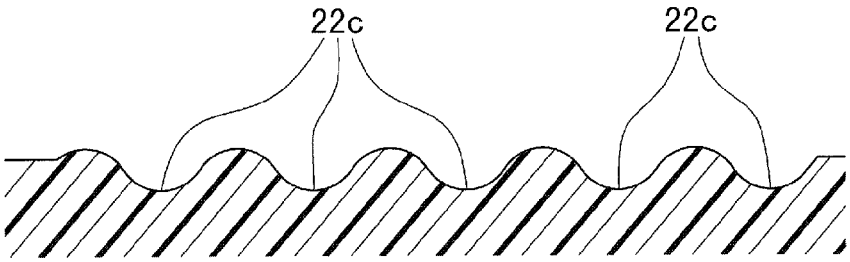
FIG. 4 is a schematic sectional view of the surface of the belt.

The grooves 22*c* in FIGS. 3 and 4 are formed as a periodic relief pattern on the surface of the belt 22, that is, the grooves 22*c* are formed at substantially equal intervals in the direction orthogonal to the direction in which the grooves 22*c* extend. In the example shown in FIG. 3, the grooves 22*c* are formed as a single continuous groove 22*c* that winds helically around the belt 22 from one edge of the belt to the opposite edge without interruption. The grooves 22*c* may, however, be formed discontinuously, as in the example shown in FIG. 5, in which groove sections and non-grooved gaps are alternately formed. The discontinuous grooves may have substantially equal length. The example in FIG. 5 is just one of many possible discontinuous groove patterns.

Figure 5:
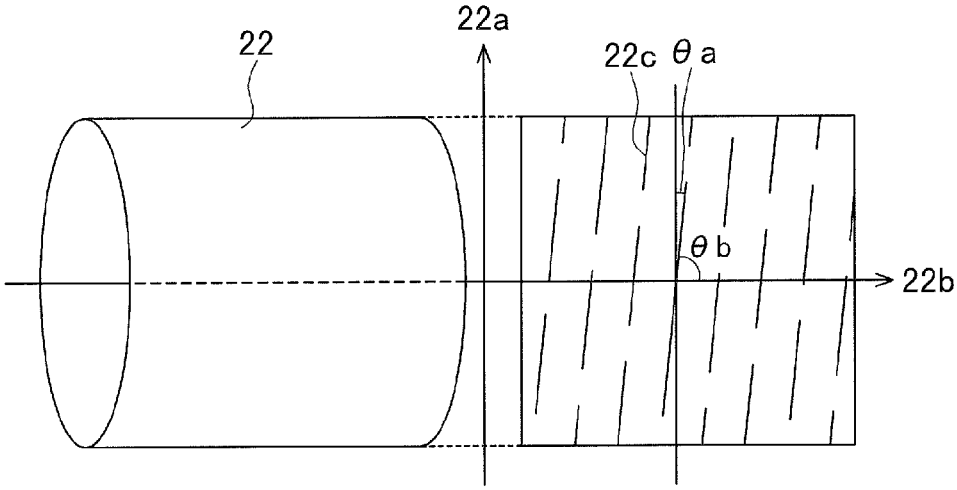
FIGS. 5 and 6 schematically illustrate other exemplary groove patterns on the belt.
Figure 6:
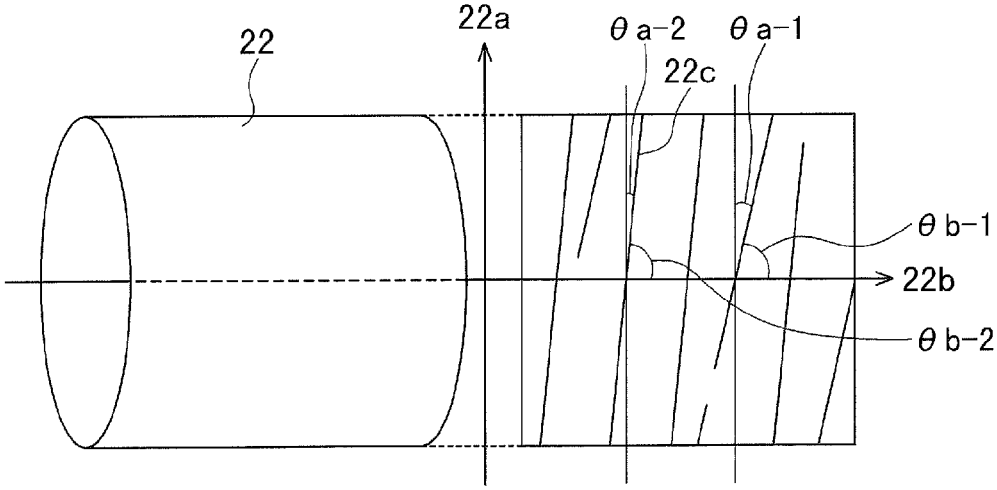

The angle θb in FIGS. 3 and 5 is constant, so that when the grooves 22*c* are viewed from any given direction, such as a direction normal to the surface of the belt 22, for example, they appear to be mutually parallel. It is also possible, however, to form a plurality of grooves 22*c* with different slant angles. An example is shown in FIG. 6 in which one set of grooves is formed with a slant angle of θb-1 and another set of grooves is formed with a different slant angle of θb-2. These angles are with respect to the axis of rotation 22*b*. The corresponding slant angles with respect to the longitudinal direction 22*a* on the belt 22 are θa-1 and θa-2. Both θa-1 and θa-2 must be strictly between 0° and 90° and are preferably between 15° and 85°, as described later.

In any of these patterns, to stabilize the sliding contact of the cleaning blade 24, the grooves 22*c* are preferably spaced at intervals of not less than 0.1 μm and not more than 100 μm. The spacing can be measured in terms of the mean spacing Sm defined in the Japanese Industrial Standards (JIS B0601-1994). For the belt 22 in this embodiment, Sm is preferably in the range from 0.1 μm to 100 μm. The more uniform the spacing is, the better.

FIGS. 3, 5, and 6 show simplified representations of the number of the grooves 22*c* and their width and spacing. The actual groove pattern is not limited to patterns like those shown in these drawings. The grooves 22*c* need only be formed with some degree of periodicity. The number of the grooves 22*c* per unit length in the direction orthogonal to the direction in which the grooves extend may be uniform over the entire surface of the belt 22 or may vary from place to place on the belt 22.

As explained below, to avoid cleaning failures, the depth of the grooves 22*c* formed on the surface of the belt 22 is preferably 2 μm or less, and to maintain the long-term effectiveness of the grooves, the depth of the grooves 22*c* is preferably at least than 0.1 μm. The depth of the grooves 22*c* can be represented by the maximum height Ry defined in the Japanese Industrial Standards (JIS B0601-1994). For the belt 22 in this embodiment, Ry is preferably in the range from 0.1 μm to 2 μm.

The belt 22 is made of a resin material including an electrically conductive material. Specifically, the belt 22 in the present embodiment is manufactured as follows using a polyamide-imide (PAI) resin as the base material. An appropriate quantity of carbon black particles is added as the electrically conductive material to provide the base material with electrical conductivity. The base material and carbon black are stirred in an N-methylpyrrolidone (NMP) solution until well mixed. The mixture is molded by a rotational molding process to form a cylinder with a wall thickness of 100 μm and an inner diameter of 198 mm. The molded cylinder is then cut into widths of 230 mm, each constituting one belt 22. The carbon black is dispersed in the polyamide-imide resin base of each belt 22.

The die used in the rotational mold has grooves ground or polished into its surface. The surface figure of the belt, including its surface roughness, the depth of the grooves 22*c*, and the values of θa and θb, is obtained by transfer of the surface figure of the die to the surface of the belt. For example, the depth of the grooves 22*c* on the surface of the belt 22 can be adjusted by varying the groove depth on the surface of the die.

The belt manufacturing process is not limited to the process described above. Grooves may be formed on the surface of the belt by other methods. For example, grooves may be formed by polishing the surface of a non-grooved belt that has been molded by a rotational or dip molding process. The belt 22 may be multi-layered, in which case the possible methods of forming grooves in the belt also include creating brush lines in the surface coating, instead of polishing the surface.

The base material of the belt 22 is not limited to PAI, provided the material provides the necessary durability and mechanical properties. These properties include limiting tensile deformation during operation to within a given range, and resistance to wear, bending, cracking, and other types of damage caused by repetitive sliding against meander prevention means such as the collars 20*a*, 21*a* shown in FIGS. 1 and 2. Among the materials that may be used are, for example, polyimide (PI), polycarbonate (PC), polyamide (PA), polyether ether ketone (PEEK), and polyvinylidene fluoride (PVdF) resins, ethylene-tetrafluoroethylene copolymer resins, and mixtures thereof. The material should, like PAI, have a Young's modulus of at least 2000 MPa, preferably at least 3000 MPa.

When the belt 22 is manufactured by a rotational molding process, the solvent should be selected according to the type of material used. Aprotic polar solvents are often used, particularly N,N-dimethyl acetoamide (DMA), N,N-diethylformamide (DMF), N,N-dimethylsulfoxide (DMS), NMP (mentioned above), pyridine, tetramethylene sulfone (TMS), and dimethyl tetramethylene sulfone (DTS). These solvents may be used separately or in combination. The belt 22 may also be manufactured by extrusion molding, without using a solvent.

There are many types of carbon black, such as furnace black, channel black, kitchen black, acetylene black, etc. These types may be used separately or in combination. The type of carbon black may be selected according to the desired level of electrical conductivity. For the belt employed in the image forming apparatus in this embodiment, channel black and/or furnace black is suitable for obtaining the proper electrical resistance. In some applications, it is preferable for the carbon black to undergo an antioxidation treatment or graft process to improve its resistance to oxidation damage or its solvent dispersability. The proper carbon black content of the belt depends on the type of carbon black and the intended use of the belt. For a belt used as in this embodiment, in view of mechanical strength and other factors, the weight proportion of carbon black to solid resin is preferably 3% to 40%, and more preferably 3% to 30%.

The method of providing electrical conductivity is not limited to the use of carbon black. An electrically conductive resin may be used as the base material instead, or an ionic conductivity promotion agent may be added to produce ionic electrical conductivity.

Belts of seventeen types with different groove angles θb and groove depths Ry were manufactured by the rotational molding method described above as test samples No. 1 to No. 17. Each of these belts was individually mounted as the belt 22 in the image forming apparatus 1 and a continuous printing test was carried out to evaluate its performance. In the following description, the reference characters of the belt 22 and grooves 22*c* will generally be omitted.

In these tests, the groove spacing Sm and depth Ry of each belt were measured according to JIS B0601-1994. The surface figure of each belt was observed with a VK8500 laser microscope manufactured by the Keyence Corporation of Osaka, Japan, and the spacing (Sm) and depth (Ry) values of a surface profile in the direction orthogonal to the grooves 22*c* were measured. The laser microscope made it possible to perform this surface profile measurement while observing the surface figure. The groove spacing Sm of each belt was 3 μm; the groove depths Ry were as shown in Table 1 below.

The main component of the toner used in the continuous printing tests was a styrene-acryl copolymer including nine parts by weight of paraffin wax. The wax was added by an emulsion polymerization method. The toner particles had an average volumetric diameter of 7 μm and an average sphericity of 0.95. This type of toner was selected for its improved transfer efficiency, improved toner fixation with less residual release agent, improved development properties, including higher dot reproducibility and resolution, and improved image sharpness and image quality.

A urethane rubber cleaning blade with a JIS A hardness of 83° and a thickness of 1.5 mm was used as a belt cleaning member. The line pressure against the belt was set at 4.3 g/mm. This type of blade was selected because a blade made of an elastic material such as urethane rubber is compact and inexpensive, is easy to manufacture, and removes residual toner and other foreign matter effectively. Urethane rubber was used because of its high hardness and elasticity and its superior abrasion resistance, mechanical strength, oil resistance, ozone resistance, and other properties.

In the continuous printing tests, A4-size plain paper copier (PPC) paper was used as the recording medium. The tests were carried out at an ambient temperature of 23° C. and a relative humidity of 50%. In each test, a four-color (black, yellow, magenta, cyan) 1% horizontal zone pattern was printed continuously on 100,000 sheets of paper by continuous two-sided printing and the occurrence of blade curl, squeak, and cleaning failure was noted. Blade curl occurs when the cleaning blade catches on the rotating belt and is bent inward. Squeak is an abnormal sound made by the cleaning blade. Cleaning failure occurs when residual toner passes the cleaning blade without being scraped off. The tests were continued when a squeak noise occurred, but were terminated when blade curl or cleaning failure occurred.

Figure 7:
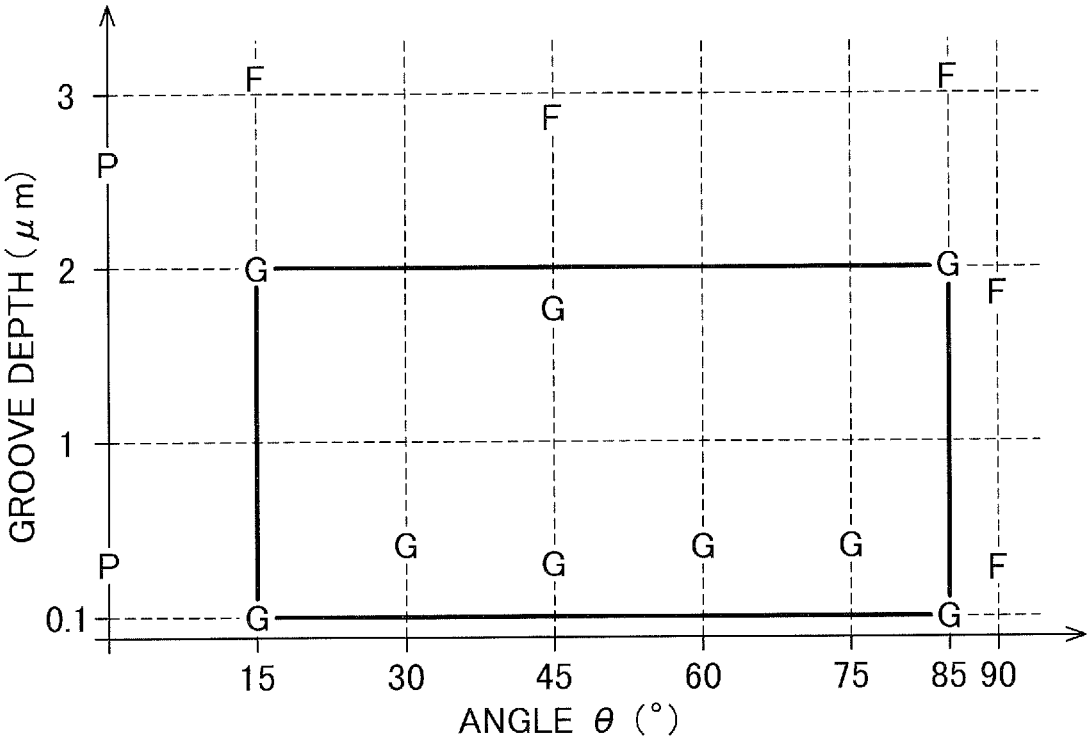
FIG. 7 shows the results of tests of sample belts in the first embodiment.

Table 1 and FIG. 7 show the test results.

Table 1 lists the groove slant angle θb, groove depth Ry, test results, and overall evaluation for each of the seventeen sample belt types (No. 1 to No. 17). Five types of belts not satisfying the condition 0°<θb<90° (belts No. 1, 2, 3, 16, 17) were included for comparison. The test results were based on blade curl, blade squeak, and cleaning failure.

In the test results for blade curl and squeak, the word Good indicates that neither blade curl nor squeak occurred, Fair indicates that blade squeak occurred but blade curl did not, and Poor indicates that blade curl occurred.

In the test results for cleaning failure, Good indicates that no cleaning failure occurred and Fair indicates that a cleaning failure occurred.

In the overall evaluation Good indicates that no blade curl, no blade squeak, and no cleaning failure occurred, Fair indicates that a cleaning failure occurred but there was no blade curl or blade squeak, Poor indicates that both blade squeak and cleaning failure occurred, and Bad indicates that blade curl occurred.

The overall evaluation results of samples No. 2 to No. 17 are plotted in FIG. 7, in which the horizontal axis represents the groove slant angle θb and the vertical axis represents the groove depth Ry. The letters G, F, and P represent Good, Fair, and Poor, respectively.

TABLE 1

| | | | Test results | | |
|---|---|---|---|---|---|
| No. | θb | Depth | Curl/squeak | Cleaning | Overall |
| 1 | No groove | — | Poor | Good | Bad |
| 2 | 0° | 0.4 μm | Fair | Fair | Poor |
| 3 | 0° | 2.6 μm | Fair | Fair | Poor |
| 4 | 15° | 0.1 μm | Good | Good | Good |
| 5 | 15° | 2.0 μm | Good | Good | Good |
| 6 | 15° | 3.1 μm | Good | Fair | Fair |
| 7 | 30° | 0.5 μm | Good | Good | Good |
| 8 | 45° | 0.4 μm | Good | Good | Good |
| 9 | 45° | 1.8 μm | Good | Good | Good |
| 10 | 45° | 2.9 μm | Good | Fair | Fair |
| 11 | 60° | 0.5 μm | Good | Good | Good |
| 12 | 75° | 0.5 μm | Good | Good | Good |
| 13 | 85° | 0.1 μm | Good | Good | Good |
| 14 | 85° | 2.0 μm | Good | Good | Good |
| 15 | 85° | 3.1 μm | Good | Fair | Fair |
| 16 | 90° | 0.4 μm | Good | Fair | Fair |
| 17 | 90° | 1.9 μm | Good | Fair | Fair |

From the test results, it was found that forming grooves on the surface of the belt is an effective way to prevent blade curl. The results also showed that slanting the grooves with respect to the longitudinal direction on the surface of the belt or, equivalently, with respect to the rotational axis provides both cleanability and resistance to blade curl.

Specifically, blade curl occurred on the non-grooved belt No. 1 tested as a comparative example. This suggests that the increased contact area between the cleaning blade and the flat surface of a belt without grooves (or similar linear surface relief) increases the friction between them, tending to cause the blade to curl. Blade curl is a serious durability problem because it can damage the blade and belt to the extent that they must be replaced. Since this is not a simple repair job, the user may prefer to replace the entire image forming apparatus.

In two other comparative examples, No. 2 and No. 3, blade squeak and cleaning failure occurred. In these belts the angle θb between the grooves and the axis of belt rotation was 0°, so the grooves were parallel to the ridge line or scraping edge of the blade. As the belt moved, the edge of the blade is thought to have caught against the convexities (hills) and concavities (valleys) of the groove pattern, especially against the convexities, causing a stick-slip motion of the blade and generating the squeak sounds. Stick-slip motion of the blade also produces uneven line pressure of the blade against the belt, which is thought to have caused the cleaning failures.

In two further comparative examples, No. 16 and No. 17, at first neither blade curl nor cleaning failure occurred, but over repeated printing cycles, cleaning failures appeared. After the completion of the tests, when the edge of the blade (its ridge line, the line of contact between the blade and the belt) was examined with a stereomicroscope, locally worn or chipped portions were observed. Since the angle θb between the groove and the direction of the rotational axis of the belt was 90°, the convexities of the groove pattern were always in contact with the same parts of the blade edge. It is thought that this caused excessive stress to be applied to localized parts of the blade, and that over time, these parts became locally abraded or chipped. At these locally abraded or chipped portions, residual toner is thought to have slipped past the blade without being removed from the belt.

Blade squeak is annoying to the user and is a sign of incipient trouble. An image forming apparatus that persistently squeaks must generally be repaired or replaced.

Cleaning failures can lead to image quality problems by, for example, creating toner stains on the reverse side of the paper 25. This is particularly unacceptable in two-sided printing. As with blade curl and squeak, repair or replacement of the image forming apparatus becomes necessary.

On belts No. 4 to No. 15, which had grooves slanted by an angle θb greater than 0° and less than 90° (0°<θb<90°, there was no occurrence of blade curl and squeak and there were almost no cleaning failures. This result and a comparison with belt No. 1 suggests that by reducing the contact area between the belt and cleaning blade, grooves (or other texture) formed on the surface of the belt can stabilize the sliding contact between blade and belt, thereby preventing the cleaning blade from curling with the rotation of the belt. In addition, a comparison with the results for belts No. 2 and No. 3 suggests that if the angle θb, is greater than 0° (0°<θb), it is possible to prevent the stick-slip motion that occurs when the blade sticks against convexities on the belt, thereby stabilizing the sliding contact between blade and belt preventing blade squeak and cleaning failure. Similarly, a comparison with the results for belts No. 16 and No. 17 suggests that if the angle θb is less than 90° (θb<90°, it is possible to avoid having localized parts of the blade remain in constant contact with convexities on the belt, thereby preventing local abrasion and chipping of the blade.

Cleaning failures occurred on belts No. 6, No. 10, and No. 15. Toner was observed to have remained in the grooves on the surfaces of these belts. This is thought to have happened because the grooves in the belts were too deep (2.9 μm to 3.1 μm deep) for the blade to completely scrape the residual toner out of the grooves. On the other belts tested, the grooves were shallower, being only 0.1 μm to 2.0 μm deep, and no cleaning failures occurred. Therefore, to obtain a belt with high cleanability, the grooves formed on the surface of the belt are preferably not more than 2 μm deep. In addition, over repeated printing cycles, grooves with depths of less than 0.1 μm may disappear, either by being worn away or by becoming filled with wax or other toner additives. Accordingly, in order to reduce the occurrence of blade curl and cleaning failure and enable the belt to last reliably over its full life span, the groove depth is preferably at least 0.1 μm. For this reason, the tests in this embodiment were confined to belts with a groove depth Ry of 0.1 μm or greater.

From the test results shown in Table 1, for reliable prevention of stick-slip motion and resultant blade squeak and cleaning failure, angle θb is preferably 15° or greater. For reliable prevention of cleaning failure due to local abrasion of the blade, angle θb is preferably 85° or less.

The above conclusions are summarized in FIG. 7. Good (G) results regarding blade curl, blade squeak, and cleaning failure were obtained in the rectangular region, indicated by the solid line, defined by the following inequalities:

$$15° \leq \theta b \leq 85°$$

$$0.1\ \mu m \leq Ry \leq 2\ \mu m$$

For improved durability of the image forming apparatus, these are the preferred ranges of the groove slant angle θb and groove depth Ry.

As described above, one or more grooves are formed on the surface of a rotating body (specifically, a belt) in this embodiment, slanted with respect to the longitudinal direction of the outer surface of the rotating body at an angle θa strictly between 0° and 90° (0°<θa<90°). With this configuration, the durability of the image forming apparatus can be improved. Specifically, the grooves reduce the area of contact between a cleaning member and the rotating body, thereby reducing friction and stabilizing the sliding contact of the cleaning member against the rotating body. The reduced friction improves the durability of the image forming apparatus by, for example, preventing blade curl. Making the angle θa less than 90° (θa<90°, θb>0° reduces stick-slip motion between convex portions on the surface of the rotating body and the cleaning member, thereby further stabilizing the sliding contact between the cleaning member and the rotating body and improving the durability of the image forming apparatus by, for example, reducing blade vibration and preventing blade squeak and cleaning failures. Making the angle θa greater than 0° (θa>0°, θb<90° keeps localized parts of the cleaning member from being in constant contact with convexities on the surface of the rotating body, thereby preventing wear and other damage to the localized sections. This improves the durability of the image forming apparatus by, for example, further reducing cleaning failures.

In the embodiment described above, the depth of the grooves formed on the surface of the rotating body is preferably 2 μm or less, to avoid the type of cleaning failure caused by toner remaining in the grooves, thereby enhancing the reliability and durability of the image forming apparatus.

Second Embodiment

The image forming apparatus in the second embodiment is as described in the first embodiment except for the critical surface tension of the belt. Repeated descriptions of the general structures shown in FIGS. 1 to 5 will be omitted.

As in the first embodiment, grooves 22*c* are formed on the surface of the belt 22. In the second embodiment, the belt 22 is given a critical surface tension γc of 42 millinewtons per meter (mN/m) or less. The critical surface tension γc of the surface of the belt is adjusted by, for example, addition of a water repellent agent to the belt material. Reducing the critical surface tension of the belt 22 increases its releasability.

Belt tests were carried out in the second embodiment as follows.

Six types of belts (No. 1 to No. 6) having different critical surface tension values were manufactured and mounted as the belt 22 in the image forming apparatus 1, and were evaluated in continuous printing tests. In the following description, the reference characters of the belt 22 and grooves 22*c* will generally be omitted.

Specifically, six belts with periodically formed grooves having a slant angle θb of 85° with respect to the rotational axis 22*b*, a groove spacing Sm of 2.9 μm, and a groove depth Ry of 1.0 μm were manufactured from a PAI resin base by the manufacturing process described in the first embodiment. To improve the oil repellency of the surface of the belts, a water repellent agent including a fluoroalkyl group as its main chain was added to the PAI resin. The amount added was varied to give each belt a different surface releasability: more added agent gave a higher releasability; less added agent gave a lower releasability, closer to the intrinsic critical surface tension γc of the resin. Addition of too much agent may lead to gradual bleeding of the added agent onto the belt surface, and the bled substance may adhere to the photosensitive drum, causing defects in printed images. For this reason, when the releasability is increased, due attention must be given to the amount of the water repellent agent added.

Figure 8:
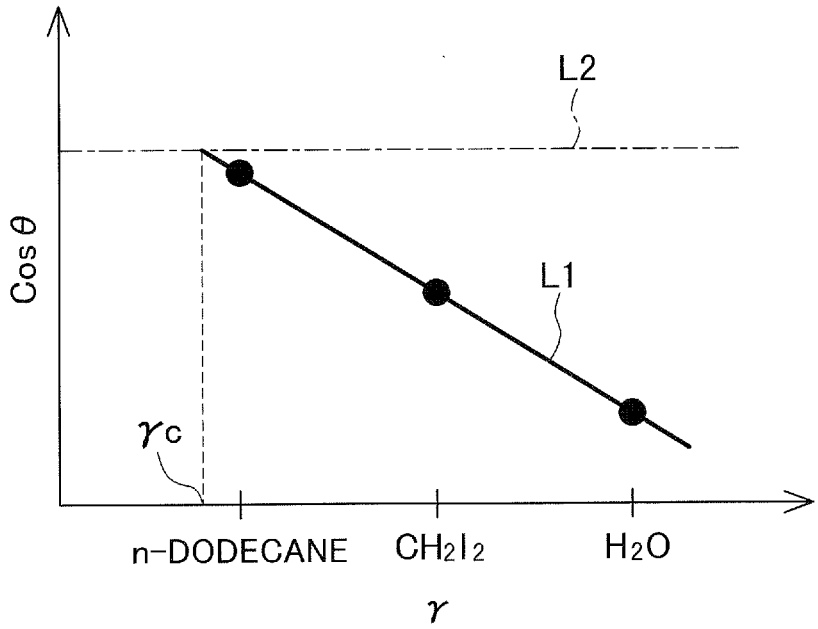
FIG. 8 shows an exemplary Zisman plot.

The mold releasability of the surface of each belt was evaluated by determining the critical surface tension γc by the Zisman method. In general, when liquid droplets are dropped onto a solid surface under test, if the surface tension of the liquid is higher than the surface tension of the solid surface, the liquid remains in a droplet form, but if the surface tension of the liquid is lower than the surface tension of the solid surface, the droplet disperses, wetting the solid surface. In the Zisman method, the contact angles of droplets of several types of liquids with different known surface tensions are measured on a solid surface, and the cosines of the contact angles of the liquids are plotted against the known surface tensions, resulting in values aligned in a straight line. The surface tension at which this line would give a cosine value of unity (1), indicating complete wetting of the surface, is calculated as the critical surface tension γc of the solid surface in question. In this example, the contact angle θ formed with the belt surface was measured for three types of liquids: n-dodecane (25.0 mN/m), diiodo-methane (50.8 mN/m), and pure water (72.8 mN/m). The cosine value (cos θ) of the contact angle θ measured for each of the liquids was plotted against the surface tension γ of the liquid, giving the Zisman plot shown in FIG. 8, from which the critical surface tension γc of the belt surface was calculated. Specifically, the surface tension value γc at the intersection of the approximation line L1 in the Zisman plot and the line L2 indicating a unity cosine value (cos θ=1) was calculated as the critical surface tension γc. The measurement of the contact angle θ was carried out at an ambient temperature of 25° C. and relative humidity of 50% with a CA-X contact angle meter manufactured by Kyowa Interface Science Co. of Niiza, Japan. For some belts, the contact angle of the liquid with the lowest surface tension (n-dodecane) could not be measured because the belt surface was wetted and no droplet was formed, so the critical surface tension γc was calculated from the measurements of the contact angles of diiodo-methane and pure water.

In the continuous printing tests, continuous two-sided printing of a four-color (black, yellow, magenta, cyan) 25% horizontal band pattern was carried out on 100,000 sheets by use of the same type of toner, cleaning blade, and recording media as in the first embodiment in a high-temperature high-humidity (HH) environment (28° C., 80% RH) to check for blade curl. Next, the image forming apparatus with the belt under test still mounted was moved from the HH environment to a low-temperature low-humidity (LL) environment (10° C., 20% RH), where it was left in the power-off state for forty-eight hours. The image forming apparatus was then powered on to see whether abnormal sounds (specifically, chattering sounds) would occur when the belt began rotating in the initial operating sequence immediately after power-up.

The test results are shown in Table 2.

For each of the six belts (No. 1 to No. 6), Table 2 lists the groove slant angle θb, the groove spacing Sm, the groove depth Ry, the critical surface tension γc, and the test results. Belt No. 6 was a comparative example having a critical surface tension γc greater than 42 mN/m. The test results concern blade curl and an abnormal sound made by the blade.

In the test results concerning blade curl, the word Good indicates that no blade curl occurred, and Poor indicates that blade curl occurred.

In the test results concerning sound, the word Good indicates that no abnormal sounds were heard, and Poor indicates that an abnormal sound was heard.

TABLE 2

| | Belt surface figure | | | | Test results | |
|---|---|---|---|---|---|---|
| No. | θb | Sm | Ry | γc | Curl | Sound |
| 1 | 85° | 2.9 μm | 1.0 μm | 5 mN/m | Good | Good |
| 2 | 85° | 2.9 μm | 1.0 μm | 15 mN/m | Good | Good |
| 3 | 85° | 2.9 μm | 1.0 μm | 23 mN/m | Good | Good |
| 4 | 85° | 2.9 μm | 1.0 μm | 35 mN/m | Good | Good |
| 5 | 85° | 2.9 μm | 1.0 μm | 42 mN/m | Good | Good |
| 6 | 85° | 2.9 μm | 1.0 μm | 47 mN/m | Good | Poor |

As shown in Table 2, no blade curl was observed during the tests. This is thought to be because of the groove pattern formed on the surfaces of the belts.

On belt No. 6, however, an abnormal sound was generated at the point of contact between the blade and belt in the LL environment. This is thought to have been due to the high (47 mN/m) critical surface tension γc of that belt, resulting in poor releasability. The wax component of the toner adheres more readily to a belt with poor releasability, and is more difficult to scrape away, so over repeated printing cycles, the wax component tends to accumulate on the surface of the belt. The low temperature in the LL environmental is thought to have caused the accumulated wax component to set, increasing the force of friction between the blade and belt, thereby generating an abnormal sound when the belt was driven. It is also thought that the wax component adhering to the surface of the belt collected in the concavities (valleys) of the groove pattern and set there in the LL environment, flattening the surface of the belt, which would increase friction between the blade and the belt and likewise tend to generate abnormal sounds.

The belts (No. 1 to No. 5) with critical surface tension values γc of 42 mN/m or less generated no abnormal sounds. Because of the high releasability of these belts, even in the HH environment, it is thought that the wax component tended not to adhere to the belt surface, or was easily scraped away even if it did adhere to the belt surface, so that after the image forming apparatus was moved into the LL environment, there was no wax component remaining on the surface of the belt to set in the grooves and generate abnormal sounds.

From the above results, the critical surface tension γc of the surface of the belt is preferably 42 mN/m or less. In terms of improving the slidability of the blade on the belt, the smaller the critical surface tension γc is, the better.

When a test droplet of a liquid a with surface tension γ1 is dropped onto a solid surface, the critical surface tension γc of the solid surface becomes equal to the surface tension γ1 of the liquid (γc=γ1) when the contact angle between the test droplet and the solid surface becomes 0°. This implies that the value of γc is in theory greater than zero, but depending on the surface figure of the solid surface under test or the value of the solubility parameter (SP) determined by the test liquid and the solid surface, the calculated value of γc may be less than zero. A calculated value of γc less than zero still clearly implies that the critical surface tension of the solid surface is low. Thus when the critical surface tension γc of the surface of the belt is calculated from measurements with the three liquids used above, the smaller the calculated result is, including calculated results less than zero, the higher the releasability is, and the smaller the calculated result is, the less likelihood there is of abnormal sounds.

According to the second embodiment described above, besides the effects produced by the first embodiment, the following effects are obtained.

In the second embodiment, the critical surface tension of the outer surface of the rotating body (belt) is 42 mN/m or less. This prevents toner components and other substances from accumulating on the surface of the rotating body, thereby improving the ruggedness and durability of the image forming apparatus by, for example, preventing the problem of abnormal sounds, regardless of environmental conditions.

The present invention is not limited to the preceding embodiments, which can be varied in many ways without departing from the scope of the invention. For example, the foregoing description concerns a direct-transfer tandem color printer as shown in FIG. 1, but the invention is equally applicable to other types of printers, and to copiers and facsimile machines.

The exemplary rotating body described above is a media transport belt, but the invention is applicable to other types of rotating bodies used in image forming apparatuses. For example, it is applicable to an intermediate transfer body that receives toner images from one or more photosensitive bodies and carries the toner images to a recording medium. Further, the invention is applicable not only to an endless belt but also to any other type of rotating body with an endless surface. For example, it is applicable to a rotating body in the form of a drum. Instead of being configured as shown in the preceding embodiments, the transfer unit may include an intermediate transfer drum, a primary transfer member for transferring a developer image onto the intermediate transfer drum, a secondary transfer member for transferring the developer image from the intermediate transfer drum to a recording medium, and a cleaning member for removing residual material adhering to the surface of the intermediate transfer drum. The schematic depictions in FIGS. 3 to 6 are specifically intended to apply to rotating bodies of both belt type and drum type.

Further, the outer surface of the rotating body may make contact or sliding contact with a component of the image forming apparatus other than the cleaning member.

Those skilled in the art will recognize that further variations are possible within the scope of the invention, which is defined in the appended claims.

What is claimed is:

1. A rotating body for use in an image forming apparatus including a cleaning blade made of an elastic material and an image carrier for carrying a developer image, the rotating body having an outer surface making contact with the cleaning blade along a line of contact, the outer surface having one or more grooves slanted with respect to the line of contact by an angle of at least 15° and at most 85°, wherein:

the rotating body is an endless belt having a single layer structure made of a resin material;

the one or more grooves have a depth of at least 0.1 μm and at most 2 μm;

the one or more grooves are formed as a single continuous or discontinuous groove that winds helically around the rotating body from one edge of the rotating body to the opposite edge;

the one or more grooves are spaced at periodic intervals in a direction orthogonal to a direction in which the one or more grooves extend;

the periodic intervals are intervals of at least 0.1 μm and at most 100 μm;

the rotating body is configured to carry, on the outer surface a recording medium onto which the developer image is transferred from the image carrier while the recording medium passes between the image carrier and the outer surface;

the resin material has a Young's modulus of at least 2000 MPa; and the outer surface has a critical surface tension of at most 42 mN/m.

2. The rotating body of claim 1, wherein the resin material includes an electrically conductive material.

3. The rotating body of claim 2, wherein the electrically conductive material is carbon black.

4. The rotating body of claim 1, wherein the resin material includes polyamide-imide.

5. A transfer unit comprising:

the rotating body of claim 1;

a drive member for turning the rotating body;

a transfer member for transferring the developer image from the image carrier onto the recording medium carried on the rotating body; and the cleaning blade making contact with the outer surface of the rotating body.

6. The transfer unit of claim 5, wherein the rotating body also has an inner surface and the transfer unit also includes a driven member making contact with the inner surface of the rotating body.

7. The transfer unit of claim 6, wherein the rotating body is entrained on the drive member and the driven member.

8. The transfer unit of claim 5, wherein the drive member turns the rotating body in a direction essentially orthogonal to the line of contact.

9. An image forming apparatus comprising:

the transfer unit of claim 5; and an image forming unit for forming the developer image on the image carrier.

* * * * *